US007118108B2

(12) United States Patent
Yu et al.

(10) Patent No.: US 7,118,108 B2
(45) Date of Patent: Oct. 10, 2006

(54) RACING BOARD GAME

(75) Inventors: Brian Yu, Hawthorne, CA (US); Jeannie Burns Hardie, Gardena, CA (US); Jim Keifer, Manhattan Beach, CA (US)

(73) Assignee: Mattel, Inc., El Segundo, CA (US)

( * ) Notice: Subject to any disclaimer, the term of this patent is extended or adjusted under 35 U.S.C. 154(b) by 24 days.

(21) Appl. No.: 10/839,971

(22) Filed: May 5, 2004

(65) Prior Publication Data

US 2005/0006843 A1 Jan. 13, 2005

Related U.S. Application Data

(60) Provisional application No. 60/468,230, filed on May 5, 2003.

(51) Int. Cl.
*A63F 3/00* (2006.01)

(52) U.S. Cl. ..... 273/248; 273/246

(58) Field of Classification Search ..... 273/249, 273/246, 248

See application file for complete search history.

(56) References Cited

U.S. PATENT DOCUMENTS 3,044,779 A 7/1962 Hvizdash
3,231,279 A 1/1966 Howarth et al.
4,033,587 A 7/1977 Oliver
4,093,238 A 6/1978 Moskowitz
4,357,017 A 11/1982 Schneider et al.
4,550,917 A 11/1985 Ferris et al.
5,092,605 A 3/1992 Hoffman
5,114,152 A 5/1992 Rouse et al.
5,139,267 A 8/1992 Trevisan
5,308,078 A 5/1994 Hatter
5,322,293 A 6/1994 Goyette
5,350,178 A 9/1994 Hollar
5,551,699 A 9/1996 Pavelich
5,560,609 A 10/1996 Grant
5,749,582 A 5/1998 Fritz et al.
5,823,872 A 10/1998 Prather et al.
5,853,173 A 12/1998 Murphy
5,934,673 A 8/1999 Telarico et al.
5,938,200 A 8/1999 Markowicz et al.
6,095,522 A 8/2000 Spell et al.
6,332,615 B1 12/2001 Watanabe
6,412,777 B1 7/2002 Rossi
6,464,223 B1 10/2002 Rutter
6,464,224 B1 10/2002 Wusterbarth

*Primary Examiner*—Vishu Mendiratta
(74) *Attorney, Agent, or Firm*—Kolisch Hartwell, PC

(57) ABSTRACT

The present invention provide rules of play and game components for a game in which players may win by correctly predicting the order in which the moving pieces will reach the finish line. Players may influence the movement of the playing pieces on the pathways by playing movement cards or cards invoking special rules.

15 Claims, 2 Drawing Sheets

RACING BOARD GAME

CROSS REFERENCE TO RELATED APPLICATION

The present application claims priority from the benefit of U.S. Provisional Application Ser. No. 60/468,230 of Brian Yu, Jeannie Burns Hardie and Jim Keifer filed May 5, 2003, the disclosure of which is incorporated by reference in its entirety for all purposes.

BACKGROUND AND SUMMARY OF THE INVENTION

The present disclosure relates to board games. More particularly, the present invention relates to rules and apparatus for playing a board game where a race is simulated and the object of the game is to correctly predict the outcome of the race.

Examples of board games that simulate racing experiences are disclosed in U.S. Pat. Nos. 3,044,779, 3,241,279, 4,033,587, 4,093,238, 4,357,017, 4,550,917, 5,092,605, 5,139,267, 5,308,078, 5,322,293, 5,350,178, 5,551,699, 5,560,609, 5,749,582, 5,823,872, 5,934,673, 6,095,522, and 6,464,223, the disclosures of which are incorporated by reference in their entirety for all purposes. Examples of board games wherein players predict the outcome of a race are disclosed in U.S. Pat. Nos. 5,823,872, 5,853,173 and 5,938,200 the disclosures of which are incorporated by reference in their entirety for all purposes.

The advantages of the present invention will be understood more readily after a consideration of the drawings and the Detailed Description.

DETAILED DESCRIPTION AND BEST MODE OF THE INVENTION

Figure 1:
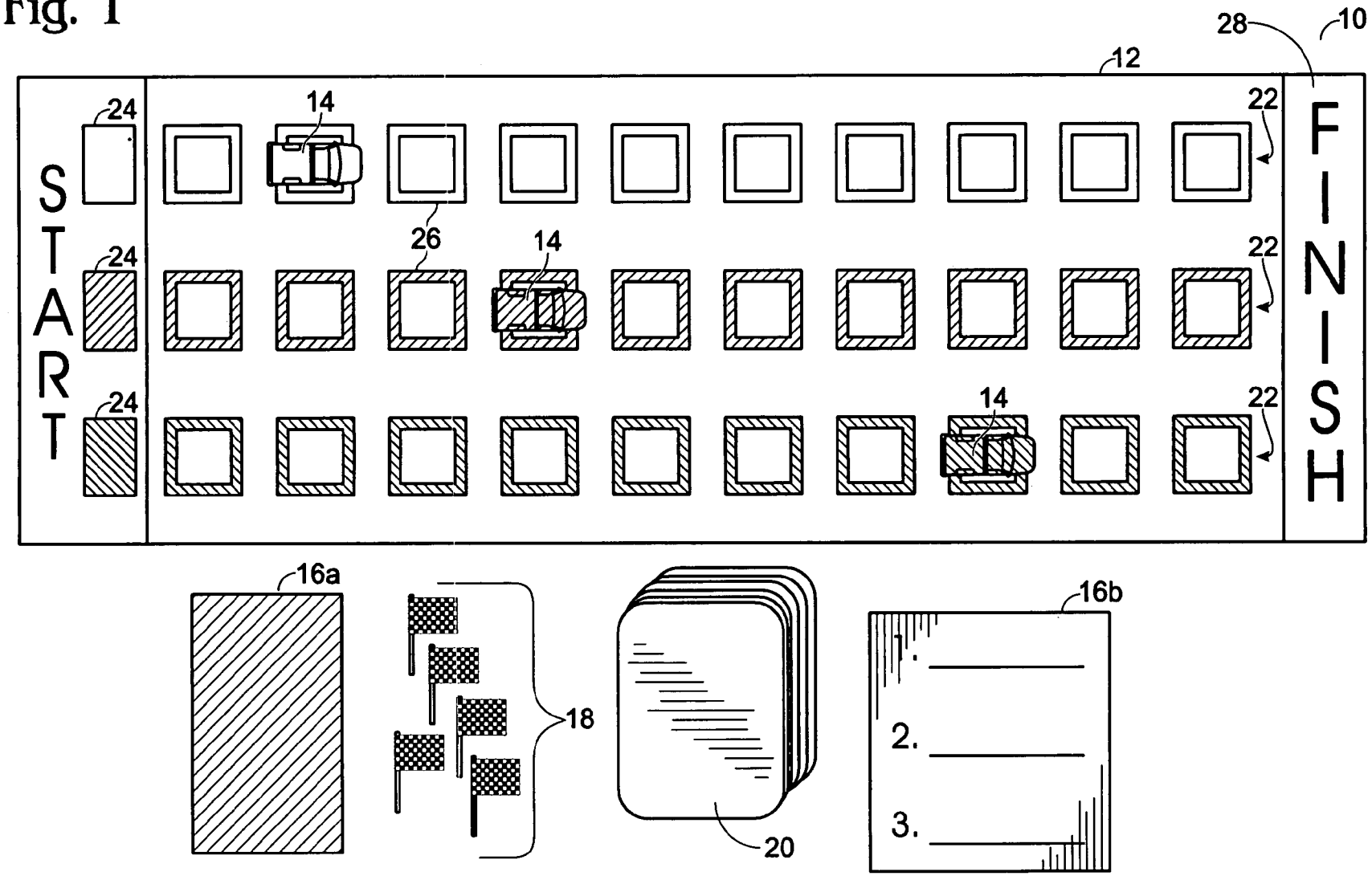
FIG. 1 depicts one embodiment of various game components suitable for use with the game of the present invention.

FIG. 1 depicts on embodiment of a game 10 according to the present invention. As shown, game 10 includes a game board 12, moving pieces or tokens 14, prediction components 16*a* and 16*b*, scoring components 18, and playing components 20.

As shown, game board 12 includes a plurality of distinguishable pathways 22, with each pathway being comprised of a starting space 24 and a plurality of intermediate spaces 26. Each pathway terminates at finish line 28. Each pathway may be associated with a unique color, pattern, drawing, or other distinguishing indicator. For example, a first pathway may include a red starting space and intermediate spaces outlined in red, a second pathway may include a blue starting space and intermediate spaces outlined in blue, and a third pathway may include a green starting space and intermediate spaces outlined in green. It will be appreciated that the game board may include a larger or smaller number of pathways than the number shown in the figure. While the pathways typically will each include the same number of intermediate spaces 26, it will be appreciated that the number of intermediate spaces may be greater or fewer than the number shown in the figure.

Moreover, while game board 12 is shown as having three parallel linear pathways 22, it will be appreciated that game board 12 may have any number of pathways, including a single pathway on which multiple moving pieces 14 travel. Moreover, pathways 22 may take any shape including one or more continuous pathways, i.e. loops, circles, ovals, etc.

Moving pieces or tokens 14 are typically sized to be placed on and travel pathways 22. Each moving piece is typically distinguishable from the others. For example, the game may include a red moving piece adapted to travel a red pathway, a blue moving piece adapted to travel a blue pathway, and a green moving piece adapted to travel a green pathway.

Prediction components 16*a*, 16*b* typically provide each player with a way to indicate his or her predicted finishing order as the moving pieces travel their pathways. For example, players may indicate the order in which they believe the red, blue, and green moving pieces will reach the finish space. Prediction components may take the form of paper or cards 16*b* with spaces to allow the players to write in their predictions. Alternatively, the players may place items bearing the pathways' colors or other distinguishing indicia in the predicted order. For example, prediction components may take the form of sets of guess marker cards 16*a*. Each card in a set may include indicia correlating the card with a particular moving piece. Thus, in keeping with the above example, each set may include a red card, a blue card and a green card. Game 10 typically includes enough sets of guess marker cards so that each player may be distributed his or her own set of guess marker cards.

Scoring components 18 may take the form of cards, chits, tokens, or other collectible items. Because scoring components 18 are typically used to indicate the score of each player, the scoring components may be eliminated entirely and/or replaced with a pencil and paper or some other method of tallying the score.

Figure 2:
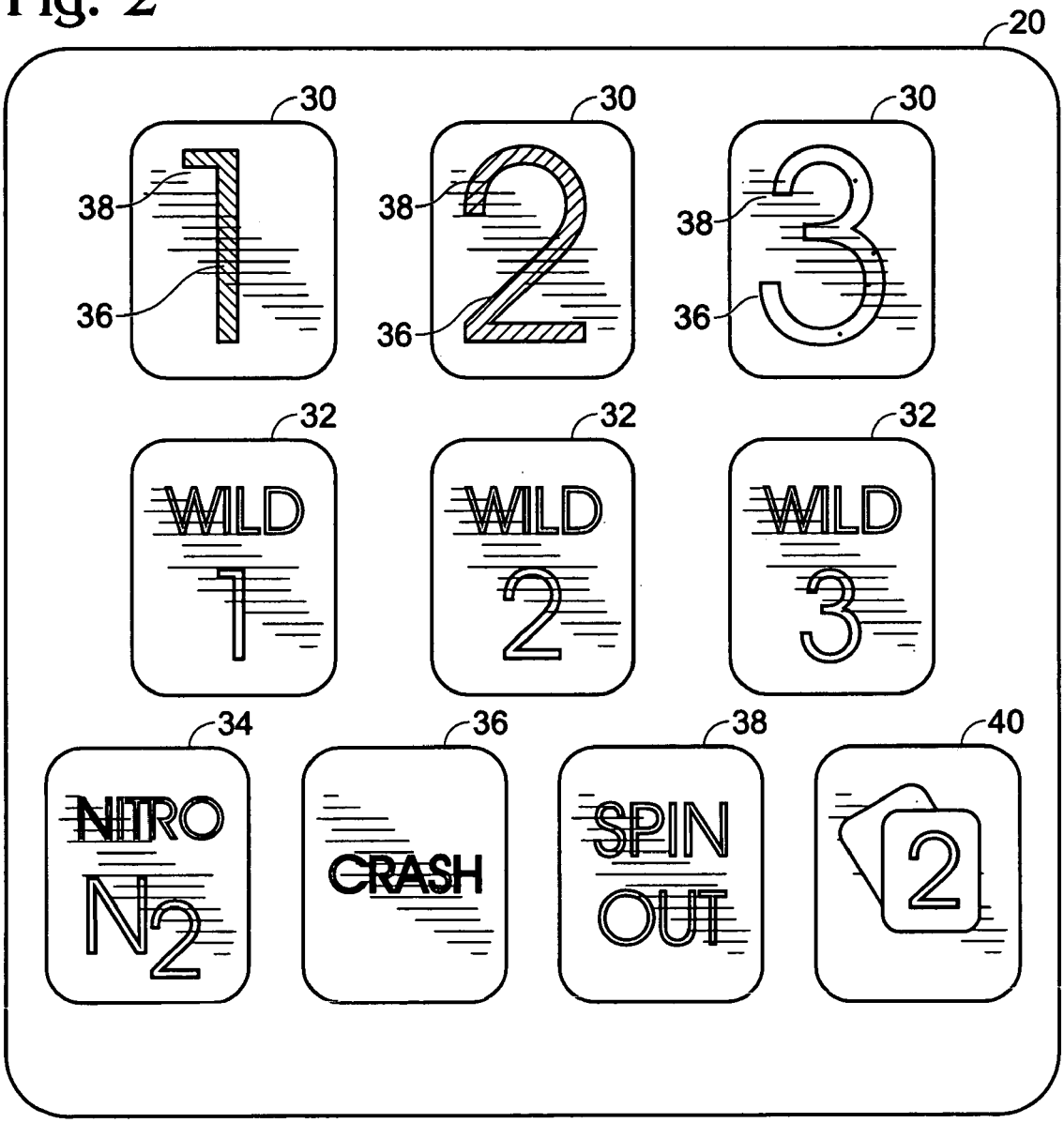
FIG. 2 depicts exemplary playing cards suitable for use with the game of the present invention.

FIG. 2 depicts exemplary playing components, which in the depicted embodiment takes the form of cards 20. Playing cards 20 may include several categories of cards including movement cards, and command cards. Movement cards are typically cards that allow or prevent movement of tokens 14 on the pathways 22. Command cards typically invoke special exceptions or additions to the rules of the game.

Movement cards may be divided into two groups of cards: path-specific movement cards 30 (which may also be referred to as moving piece-specific or token-specific cards), and general movement, or wild, cards, 32. Each path-specific card 30 typically includes pathway indicia 36, which indicates the pathway with which the card is associated. For example, in an embodiment where the game board includes a red pathway, a subset of the path-specific cards may include red indicia. Each path-specific card 30 typically further includes movement indicia 38, indicating the number of spaces a moving piece traveling the associated pathway may move. It will be appreciated that the pathway indicia and movement indicia may be the same. For example, a particular path-specific card may include a red number "3,"

indicating that a moving piece on the red pathway may be moved three spaces. It will be appreciated that the movement indicia need not be limited to Arabic numerals and may take other suitable forms.

Typically, general movement cards 32 do not include pathway indicia. However, each general movement card 32 will typically include movement indicia.

As stated above, command cards typically invoke special exceptions or additions to the rules of the game. The special exceptions or additions may be described on the face of each card, or may be indicated by specific indicia. Command cards may be divided into two groups of cards: pathway altering cards and rule altering cards.

Pathway altering cards are typically cards that alter the shape or length of the pathway, for example by increasing or decreasing the number of spaces that make up the pathway. Pathway altering cards typically include indicia corresponding to their intended use. For example, Nitro card 34, described in greater detail below, includes pathway-shortening indicia and crash card 36, also described in greater detail below, includes pathway lengthening indicia.

Rule altering cards typically allow a player to perform an action that would otherwise be contrary to the rules. Rule altering cards typically include indicia corresponding to their intended use. For example spin-out card 38, described in greater detail below, includes movement stoppage indicia and 2 card 40, includes play card indicia.

It will be appreciated that indicia corresponding to the intended use of a card may take the form of a written description, color, word, picture, or any other suitable format.

The categories of movement cards and command cards should not be considered as exclusive. Some cards my act as both movement cards and command cards. For example, because spin-out card 38 also effects the ability of a moving piece to travel along a pathway, it may be considered both a movement card and a command card.

Typically, all playing cards 20 have a common back and are sized identically so that they may be placed in a deck and selected or dealt randomly. Moreover, as explained in greater detail below, cards 20 may be sized so that when placed in a particular orientation on a pathway 24, a single card covers two intermediate spaces 26.

Game 10 will typically include rules of play. According to one possible set of rules for play, the game may be played by at least two players. The players may win by correctly predicting the order in which the moving pieces will reach the finish line. Players may influence the movement of the playing pieces on the pathways by playing cards.

In one embodiment, the present invention is a game played by at least two players. The players win by correctly predicting the outcome of a Monster Truck race. In this embodiment, the game components, including garneboard 12 and playing cards 20, may include backgrounds, drawings, or other indicia that invoke the idea of a Monster Truck race. Moreover, moving pieces 14 may be shaped to resemble Monster Trucks. In this embodiment, playing cards 16 may include command cards such as $NO_2$ (Nitro), Crash, Spinout, and 2 cards. An exemplary method of playing a game according to the presently described embodiment is described below. It will be appreciated that the following description is for exemplary purposes only and that no limitation is implied or should be inferred from the specific embodiment described.

According to one method of playing game 10, players may play the game by attempting to predict the order in which they believe moving pieces 14, which may take the form of trucks, will reach finish line 28. Players move the trucks towards the finish line 28 by drawing and playing numbered movement cards (path-specific cards 30 and wild cards 32) and command cards (cards 34, 36, 38 and 40).

Players may score a point for every correct guess. Points may be represented by a physical token, such as a checkered flag. The winner may be determined by the first player to score a predetermined number of points. For example, the first player to collect 10 points may be determined the winner.

Game board 12 may be provided to players in a format such that is can be folded up. Accordingly, players may initially open game board 12 in order to begin play. Players may then place their colored truck movers 14 on their corresponding start spaces 24 on the board. Each player may then be distributed a prediction component, such as a set of guess marker cards 16*a*.

The players may then determine who will be the dealer. The dealer may be determined using any method. For example by who is the oldest. Initially cards 20, including the path-specific cards 30, wild cards 32, and special cards 34 are all shuffled together to form a deck of cards. The dealer then deals everyone a predetermined number of cards from the deck. For example, the dealer may deal everyone 7 cards. The remaining cards are placed face down on the playing surface to form the draw pile. It will be appreciated that the number of cards dealt to each player may be more or less than 7.

After looking at their cards, each player makes an educated guess as to the order in which he or she believe the trucks will reach the finish line (i.e., finish the race) using his or her guess marker cards. Each player may arrange his or her guess marker cards so that the cards are ordered in the same sequence in which the player believes the movers will reach the finish line. For example, in an embodiment where the lanes and corresponding trucks are red, blue and green, the players may each be distributed a set of cards including one red, one blue, and one green card. If a player believes the blue truck will reach the finish line first, the red truck second and the green truck third, the player may arrange his or her cards so that the blue card is on top, the red card in the middle and the green truck on the bottom. Alternatively, in an embodiment where the prediction component takes the form of a prediction card on which players may write their guesses, players may write their guesses on their prediction cards.

Typically, the guess or prediction is kept secret from the other players. For example, the players may conceal their guesses by turning their guess marker or prediction cards face down. According to one method of play, once a guess is made, a player may not adjust his or her guess.

The players may determine an order in which to play. For example, the youngest player may play first. The first player takes a card from his or her hand and plays the card, for example by placing the card face up on the playing surface.

If appropriate, the first card played becomes the discard pile. Play moves around clockwise with each player taking one or more card from his or her hand and placing the card face up (unless otherwise indicated by the rules) in the discard pile. After playing cards, players always draw enough cards to bring their hand back up to seven cards. If the draw pile runs out, the cards in the discard pile may be shuffled and used as the draw pile.

Cards with Colored Numbers (i.e., path-specific cards 30) can only move the truck of that color that many spaces, either forwards or backwards (i.e. a red 2 can move the red truck either 2 spaces towards or away from the finish line.) Wild Cards with Numbers (i.e. wild cards 32) can move ANY colored truck that amount of spaces. Wild Command Cards (i.e. cards 34, 36, 38, 40) can work on any truck as well, unless otherwise specified by the rules or indicia on the card.

To play the $NO_2$, or Nitro, card 34*a*, the player must decide what colored truck they wish to move more quickly towards the finish line. By laying this card on the board across the track for that color, this card turns 2 spaces into a jump. In other words, the Nitro card allows a player to combine two spaces into a single space, thereby shortening the specified pathway.

When a player plays the crash card 34*b*, they must choose which colored truck they wish to hinder. This card is laid on the board and it turns 2 spaces of a colored trucks path into 5 spaces. In other words, the crash card allows a player to turn two spaces into five spaces, thereby lengthening the specified pathway.

When a player plays the spinout card 34*c*, they must decide which colored truck to disable for a turn. For the specified truck, NO ONE may play ANY cards, wild or otherwise, until the beginning of that players next turn.

By playing the 2 cards card 34*d*, a player is able to play 2 additional cards this turn (a total of 3 cards). These cards do not have to be the same color.

After a truck has crossed the finish line 28, cards may not be played against it. The cards of the first place truck become wild after it has placed. For example, if the red truck was the first truck to reach the finish line, all red movement-specific cards may be used on either the blue truck or the green truck. After a truck finishes the race, it may be positioned somewhere so as to indicate its placement in the race. For example, gameboard 12 may include a "victory" row area (not shown) showing various placements, such as $1^{st}$, $2^{nd}$ and $3^{rd}$. After a truck finished the race, the truck may be moved to victory row and placed on the space that matches its placement in the race. After all three trucks finish the race, players turn their Guess Marker Cards or otherwise reveal their guesses. One checkered flag point is awarded for every correct guess. Players may continue to conduct races until a player has accumulated a predetermined number of points, such as ten.

It is noted that according to the above-described embodiment of the game, individual player movers are not associated with individual players. Instead, at any stage of the game which mover is moved by which player is determined by the cards in the players hand and the player's desire.

It is believed that the disclosure set forth above describes multiple exemplary embodiments. While each of these embodiments may have been disclosed in a preferred form, the specific embodiments thereof as disclosed and illustrated herein are not to be considered in a limiting sense as numerous variations are possible. The subject matter of the present disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements, and/or properties may be claimed in a related application. Such claims, whether they are different, broader, narrower or equal in scope to any original claims, are also regarded as included within the subject matter of the present disclosure.

What is claimed is:

1. A method of playing a game by at least two players where the game includes a game board having at least one pathway having a beginning and an end, a plurality of tokens, and a plurality of playing components; the method comprising:

randomly distributing a plurality of playing components to each player to form a hand of playing components for each player;

recording each player's prediction of a finish order for the tokens;

playing a player-selected playing component from the player's hand in order to move the token on the pathway;

identifying an actual finish order for the tokens based on the order in which the tokens are moved across the pathway;

comparing the actual finish order to each player's predicted finish order to determine the accuracy of the predicted finish order; and awarding points to each player based on the accuracy of the player's predicted finish order.

2. The method of claim 1 where a subset of the playing components are token-specific movement generators and the method further comprises moving the token associated with the token-specific movement generator when a token-specific movement generator is played.

3. The method of claim 1 where the game board includes a plurality of pathways and a subset of the playing components are pathway lengthening components, the method further comprising playing a pathway lengthening components by selecting one of the plurality of pathways and placing the pathway lengthening component on a playing surface so as to indicate that the selected pathway has been lengthened.

4. The method of claim 1 where the game board includes a plurality of pathways and a subset of the playing components are pathway shortening components, the method further comprising playing a pathway shortening component by selecting one of the plurality of pathways and placing the pathway shortening component on a playing surface so as to indicate that the selected pathway has been shortened.

5. The method of claim 1 where a subset of the playing components are movement stoppage components, the method comprising playing a movement stoppage component by selecting a token and placing the movement stoppage component on a playing surface so as to indicate that the selected token may not be moved for a predetermined amount of time.

6. The method of claim 1 further comprising each player accumulating points until one player has accumulated a predetermined number of points.

7. The method of claim 1 where a subset of the playing components are general movement generators and the method further comprises selecting any one of the tokens on the game board and moving the selected token when a general movement generator is played.

8. A method of playing a game by at least two players including a game board having at least one pathway with a beginning and an end, a plurality of tokens, and a plurality of playing components having a subset of general movement generators; the method comprising:

randomly distributing a plurality of playing components to each player to form a hand of playing components for each player;

recording each player's prediction of a finish order for the tokens;

playing a player-selected playing component from the player's hand in order to move a token on the pathway;

selecting any one of the tokens on the game board and moving the selected token when a general movement generator is played, wherein the selected token may not be moved again until each player has completed a turn;

identifying an actual finish order for the tokens based on the order in which the tokens are moved across the pathway;

comparing the actual finish order to each player's predicted finish order to determine the accuracy of the predicted finish order; and awarding points to each player based on the accuracy of the player's predicted finish order.

9. The method of claim 1, further comprising distributing a plurality of predictor elements to each player.

10. The method of claim 9 further comprising each player arranging the predictor elements so as to represent their prediction of the finish order.

11. A method of playing a game, the game including a plurality of cards including token-specific movement cards and general movement cards, a plurality of distinguishable tokens, and a game board including a pathway having a start position and a finish position, the method comprising:

placing the plurality of tokens at the start position;

dealing a hand of cards to each player;

each player taking turns playing cards and moving tokens on the game board, each turn comprising:

drawing a card from the draw pile and adding it to the player's hand;

selecting a card from the hand;

playing the selected card on a playing surface; and moving a token associated with the token-specific card if the played card is a token-specific movement card; or selecting any token on the game board to move and moving the selected token if the played card is a general movement card.

12. The method of claim 11 where the game includes a plurality of pathways and the plurality of cards includes pathway lengthening cards, the method further comprising selecting a pathway and placing the pathway lengthening card on a playing surface so as to indicate that the selected pathway has been lengthened, if the played card is a pathway lengthening card.

13. The method of claim 11 where the game includes a plurality of pathways and the plurality of cards includes pathway shortening cards, the method further comprising selecting one of the plurality of pathways and placing the pathway shortening card on a playing surface so as to indicate that the selected pathway has been shortened, if the played card is a pathway shortening card.

14. The method of claim 11 where the plurality of cards includes movement stoppage cards, the method comprising selecting a token and placing the movement stoppage card on a playing surface so as to indicate that the selected token may not be moved for a predetermined amount of time, if the played card is a movement stoppage card.

15. The method of claim 11 where once a token reaches the finish position, all token-specific movement cards associated with the token become general movement cards.

* * * * *